US010034076B2

(12) United States Patent
Matsuo et al.

(10) Patent No.: US 10,034,076 B2
(45) Date of Patent: Jul. 24, 2018

(54) EARPHONE

(71) Applicant: SONY CORPORATION, Tokyo (JP)

(72) Inventors: Tomohiro Matsuo, Tokyo (JP); Akihiro Ogata, Saitama (JP); Kazuyasu Tsunezumi, Kanagawa (JP); Takashi Yamazaki, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/519,473

(22) PCT Filed: Oct. 1, 2015

(86) PCT No.: PCT/JP2015/005005

§ 371 (c)(1),
(2) Date: Apr. 14, 2017

(87) PCT Pub. No.: WO2016/063462

PCT Pub. Date: Apr. 28, 2016

(65) Prior Publication Data

US 2017/0230741 A1 Aug. 10, 2017

(30) Foreign Application Priority Data

Oct. 24, 2014 (JP) ..... 2014-217527

(51) Int. Cl.

| | |
|---|---|
| ***H04R 1/10*** | (2006.01) |
| ***H04R 11/02*** | (2006.01) |
| ***H04R 5/033*** | (2006.01) |
| ***H04R 23/02*** | (2006.01) |
| ***H04R 13/00*** | (2006.01) |
| ***H04R 25/02*** | (2006.01) |

(52) U.S. Cl.
CPC ..... *H04R 1/1016* (2013.01); *H04R 5/033* (2013.01); *H04R 11/02* (2013.01); *H04R 13/00* (2013.01); *H04R 23/02* (2013.01); *H04R 25/02* (2013.01)

(58) Field of Classification Search
None
See application file for complete search history.

(56) References Cited

U.S. PATENT DOCUMENTS

| | | | | |
|---|---|---|---|---|
| 6,205,227 | B1 | 3/2001 | Mahoney et al. | |
| 2006/0133631 | A1* | 6/2006 | Harvey | H04R 1/1016 381/312 |
| 2006/0133636 | A1 | 6/2006 | Harvey et al. | |
| 2008/0240485 | A1* | 10/2008 | Dyer | H04R 1/1016 381/380 |
| 2011/0051981 | A1 | 3/2011 | Lehdorfer et al. | |

(Continued)

FOREIGN PATENT DOCUMENTS

| | | | |
|---|---|---|---|
| AU | 4676199 | A | 1/2000 |
| AU | 2002368107 | A1 | 2/2004 |

(Continued)

OTHER PUBLICATIONS

Extended European Search Report of EP Patent Application No. 15852723.4, dated Apr. 24, 2018, 8 pages.

*Primary Examiner* — Paul Huber
(74) *Attorney, Agent, or Firm* — Chip Law Group

(57) ABSTRACT

An earphone includes: a housing; a dynamic driver unit provided in the housing; and a sound conduit having a length of approximately 10 mm or more, the sound conduit being configured to transmit sound output from the dynamic driver unit.

18 Claims, 7 Drawing Sheets

(56) References Cited

U.S. PATENT DOCUMENTS

| | | | | |
|---|---|---|---|---|
| 2011/0058702 | A1* | 3/2011 | Saggio, Jr. ..... | H04R 1/1016<br>381/380 |
| 2014/0169583 | A1 | 6/2014 | Huang et al. | |
| 2014/0205131 | A1* | 7/2014 | Azmi ..... | H04R 1/1075<br>381/380 |

FOREIGN PATENT DOCUMENTS

| | | | |
|---|---|---|---|
| CA | 2318922 | A1 | 8/1999 |
| CN | 102014325 | | 4/2011 |
| CN | 203378015 | U | 1/2014 |
| EP | 1050192 | A1 | 11/2000 |
| EP | 1093700 | A1 | 4/2001 |
| EP | 1535489 | A1 | 6/2005 |
| EP | 2306755 | A1 | 4/2011 |
| EP | 2744222 | A2 | 6/2014 |
| JP | 2002-502211 | A | 1/2002 |
| JP | 2005-533453 | A | 11/2005 |
| JP | 4058698 | B2 | 3/2008 |
| JP | 2011-041241 | A | 2/2011 |
| JP | 2013-143735 | A | 7/2013 |
| JP | 3188023 | U | 12/2013 |
| JP | 2014-155229 | A | 8/2014 |
| KR | 10-2001-0040498 | A | 5/2001 |
| KR | 10-2014-0077101 | A | 6/2014 |
| WO | 99/39548 | A1 | 8/1999 |
| WO | 00/01196 | A1 | 1/2000 |
| WO | 2004/010734 | A1 | 1/2004 |

* cited by examiner

EARPHONE

CROSS REFERENCE TO RELATED APPLICATIONS

This application is a U.S. National Phase of International Patent Application No. PCT/JP2015/005005 filed on Oct. 1, 2015, which claims priority benefit of Japanese Patent Application No. JP 2014-217527 filed in the Japan Patent Office on Oct. 24, 2014. Each of the above-referenced applications is hereby incorporated herein by reference in its entirety.

TECHNICAL FIELD

The present technology relates to an earphone.

BACKGROUND ART

In recent years, demand for what is called custom-made earphones and hearing aids (Patent Document 1), which are produced with an impression of a user's ear taken to fit the shape of the user's ear, has grown. Such custom earphones and hearing aids have an advantage of a good fit since they are produced, fitting the shape of a user's ear.

CITATION LIST

Patent Document

Patent Document 1: Japanese Patent No. 4058698

SUMMARY OF THE INVENTION

Problems to be Solved by the Invention

In order to achieve target acoustic characteristics such as acoustic characteristics that match a user's preference, it is necessary for such custom earphones and hearing aids to appropriately design positions, dimensions, and the like of portions to fit the shape and the like of the user's ear.

The present technology has been made considering such a point. An object thereof is to provide an earphone that outputs a sound from a driver unit with appropriate acoustic characteristics.

Solutions to Problems

To solve the problem, the present technology is an earphone including: a housing; a dynamic driver unit provided in the housing; and a sound conduit having a length of approximately 10 mm or more, the sound conduit being configured to transmit sound output from the dynamic driver unit.

Effects of the Invention

According to the present technology, the sound from the driver unit can be output with appropriate acoustic characteristics. Incidentally, the effects described herein are not necessarily restricted. Any of the effects described in the description may appear.

MODE FOR CARRYING OUT THE INVENTION

An embodiment of the present technology is described hereinafter with reference to the drawings. Incidentally, descriptions are given in the following order:

<1. Embodiment>

[1-1. Configuration of the Earphone]

[1-2. Acoustic Characteristics of the Earphone]

<2. Modifications>

1. Embodiment

[1-1. Configuration of the Earphone]

Figure 1A:
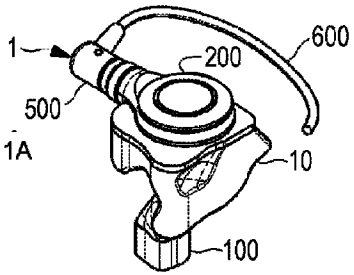
FIG. 1A is a perspective view illustrating an outer appearance of an earphone according to the present technology.
Figure 1G:
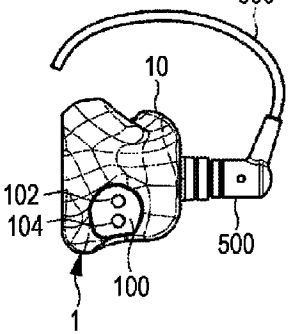
FIGS. 1B to 1G are six orthographic views of the earphone.
Figure 1D:
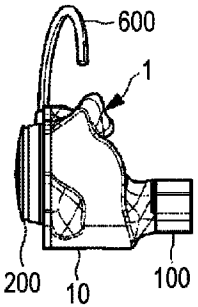
Figure 1E:
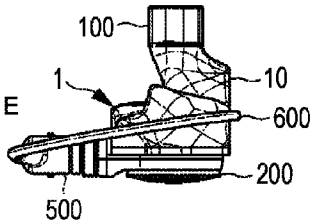
Figure 1B:
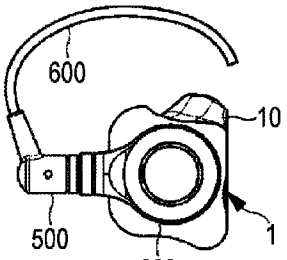
Figure 1F:
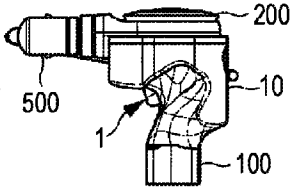
Figure 1C:
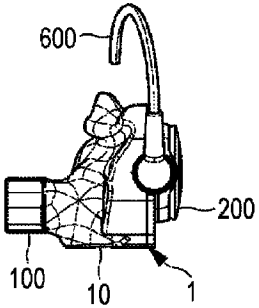
Figure 2:
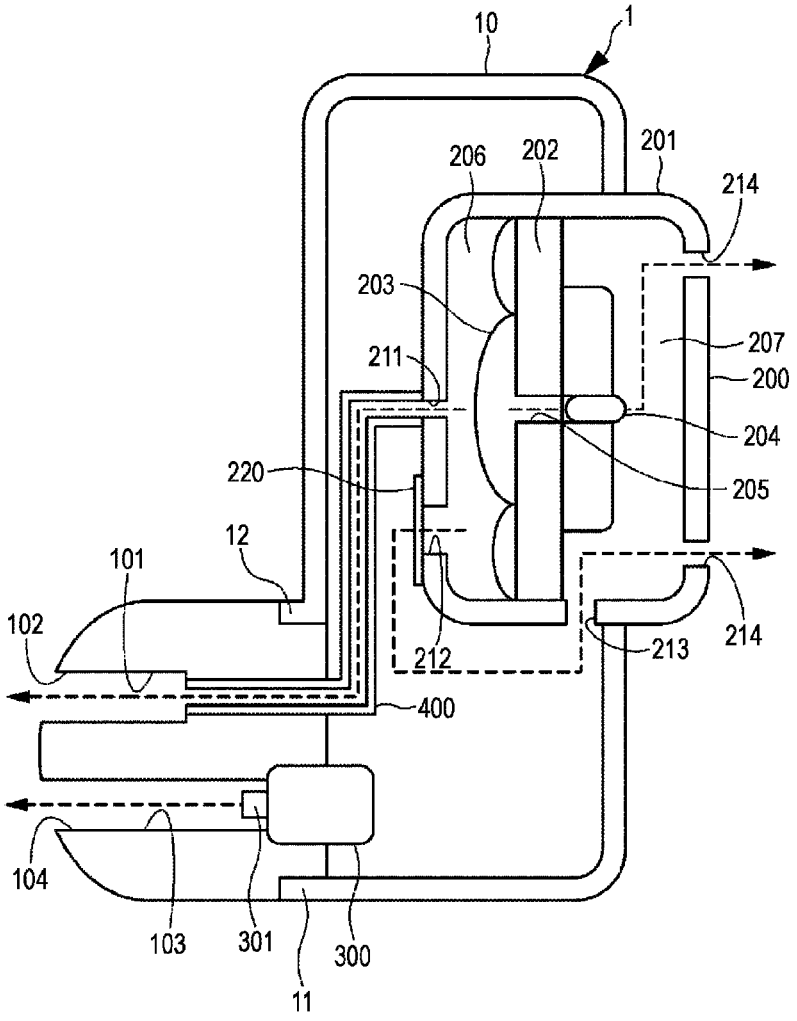
FIG. 2 is a schematic diagram illustrating an internal structure of the earphone.

The configuration of an earphone 1 according to the embodiment is described. FIG. 1A is a perspective view illustrating an outer appearance of the earphone 1. FIGS. 1B to 1G are six orthographic views of the earphone 1. FIG. 1B is a front view. FIGS. 1C and 1D are side views. FIG. 1E is a top view. FIG. 1F is a bottom view. FIG. 1G is a rear view. Moreover, FIG. 2 is a schematic diagram illustrating an internal configuration of the earphone 1.

The earphone 1 includes a housing 10, an insertion portion 100, a dynamic driver unit 200, a balanced armature driver unit (hereinafter referred to as the BA driver unit 300), a sound conduit 400, a cylindrical portion 500, and a cord 600.

The housing 10 is configured to be hollow inside, and accommodates the dynamic driver unit 200, the BA driver unit 300, and the like therein. The housing 10 is made of UV hardening resin. Incidentally, the housing 10 is configured to be open on one side. The opening on the one side exposes part of the dynamic driver unit 200 provided in the housing 10. Moreover, the insertion portion 100 is fixed on the other side.

The insertion portion 100 is inserted into the external auditory meatus of a user's ear when the earphone 1 is worn. The insertion portion 100 is configured to be more flexible than the housing 10, using UV hardening resin having thermoplasticity. The use of the UV hardening resin having thermoplasticity allows deformation thereof to fit the shape of the external auditory meatus of the user's ear since the UV hardening resin is softened by the body temperature of the user.

When a person moves his/her jaw or becomes nervous, the external auditory meatus of his/her ear changes a shape thereof accordingly. Hence, when the insertion portion 100 has flexibility and thermoplasticity, the insertion portion 100 that better fits the shape of the external auditory meatus of the user's ear can be made. Accordingly, the fit can be improved. A distal end of the insertion portion 100 has a rounded shape to be easily inserted into the external auditory meatus of the user.

Incidentally, in the structure where the insertion portion 100 is provided on one side of the housing 10, it is desirable to have a configuration that distal ends 11 and 12 of the housing 10 are placed inside the insertion portion 100, as illustrated in FIG. 2. With such a configuration, the connection between the housing 10 and the insertion portion 100 can be made stronger.

Incidentally, in the embodiment, it is desirable to configure the housing 10 with a thickness that falls within a range of approximately 0.5 to approximately 1.5 mm. UV radiation time for obtaining this thickness of the housing 10 is approximately 40 seconds although it varies depending on, for example, the kind of UV hardening resin.

The housing 10 and the insertion portion 100 are formed by inserting an ear impression material such as a silicone-based material into the user's ear and hardening it, taking an impression of the ear, using the obtained impression, pouring UV hardening resin into a female mold made with the impression, and applying ultraviolet light for a predetermined period of time. The user's impression is used for production of the earphone 1 according to the embodiment. The earphone 1 is what is called a custom earphone. Hence, the housing 10 and the insertion portion 100 of the custom earphone produced in this manner have shapes that fit the shape of the user's ear. There is an advantage that an earphone with a good fit can be tailored for each user to fit the shape of his/her ear.

A narrow hole-like first sound guide hole 101 and second sound guide hole 103 are formed inside the insertion portion 100. The details will be described later, but the first sound guide hole 101 outputs sound from the dynamic driver unit 200 by guiding the sound from the distal end of the insertion portion 100 to the outside. Moreover, the second sound guide hole 103 outputs sound from the BA driver unit 300 by guiding the sound from the distal end of the insertion portion 100 to the outside.

A distal end of the first sound guide hole 101 is open as a first sound output port 102. The sound from the dynamic driver unit 200 travels through the inside of the first sound guide hole 101, and is output last from the first sound output port 102. Moreover, a distal end of the second sound guide hole 103 is open as a second sound output port 104. The sound from the BA driver unit 300 travels through the inside of the second sound guide hole 103, and is output last from the second sound output port 104.

It is required to provide the first sound output port 102 and the second sound output port 104 adjacently at the distal end of the insertion portion 100 in a state where an interval is made as small as possible. This is because the sound of the dynamic driver unit 200 output from the first sound output port 102 and the sound of the BA driver unit 300 output from the second sound output port 104 are output as the final sound of the earphone 1. Furthermore, it is because it is necessary to introduce the sound output from the second sound output port 104 into the first sound output port 102 to adjust the acoustic characteristics of the BA driver unit 300. This point is described below.

The dynamic driver unit 200 includes a case 201, a frame 202, a diaphragm 203, and an airflow resistor 204. Furthermore, although the illustration is omitted, the dynamic driver unit 200 also includes a magnet, a plate, and a voice coil. The frame 202 has a substantially disc shape, and is provided on one side with the diaphragm 203. The frame 202 has a hole-shaped air vent 205 at its substantially center part in such a manner as to penetrate through it.

A space (hereinafter referred to as a first air chamber 206) is formed between the frame 202 and the diaphragm 203. The first air chamber 206 and a second air chamber 207 being a space on an opposite side to the side provided with the diaphragm 203 are spatially connected by the air vent 205.

The airflow resistor 204 is provided inside the air vent 205 in such a manner as to block the air vent 205. The airflow resistor 204 is made of, for example, compressed urethane or a nonwoven fabric, and acts as a resistance component against the flow of air. However, the material of the airflow resistor 204 is not limited to them. Another material can be used as long as it can add predetermined resistance to the flow of air.

The dynamic driver unit 200 employs a driving method that is widely used in the earphone 1. The dynamic driver unit 200 generates a sound by transmitting an audio signal to the diaphragm 203. The audio signal here is an electrical signal on which audio information is superimposed. The diaphragm 203 vibrates in response to the audio signal, which results in compression and rarefaction of the surrounding air to generate a sound corresponding to the audio signal. The dynamic driver unit 200 includes the large diaphragm 203 and accordingly can achieve a powerful low-frequency output.

Incidentally, a sound-absorbing material (not illustrated) such as compressed urethane is filled in the case 201 of the dynamic driver unit 200. The amount of the sound-absorbing material is adjusted to achieve the adjustment of the sound volume level of the dynamic driver unit 200.

The dynamic driver unit 200 configured in this manner is provided in the housing 10 in a state where a part thereof is exposed from the housing 10.

Figure 3:
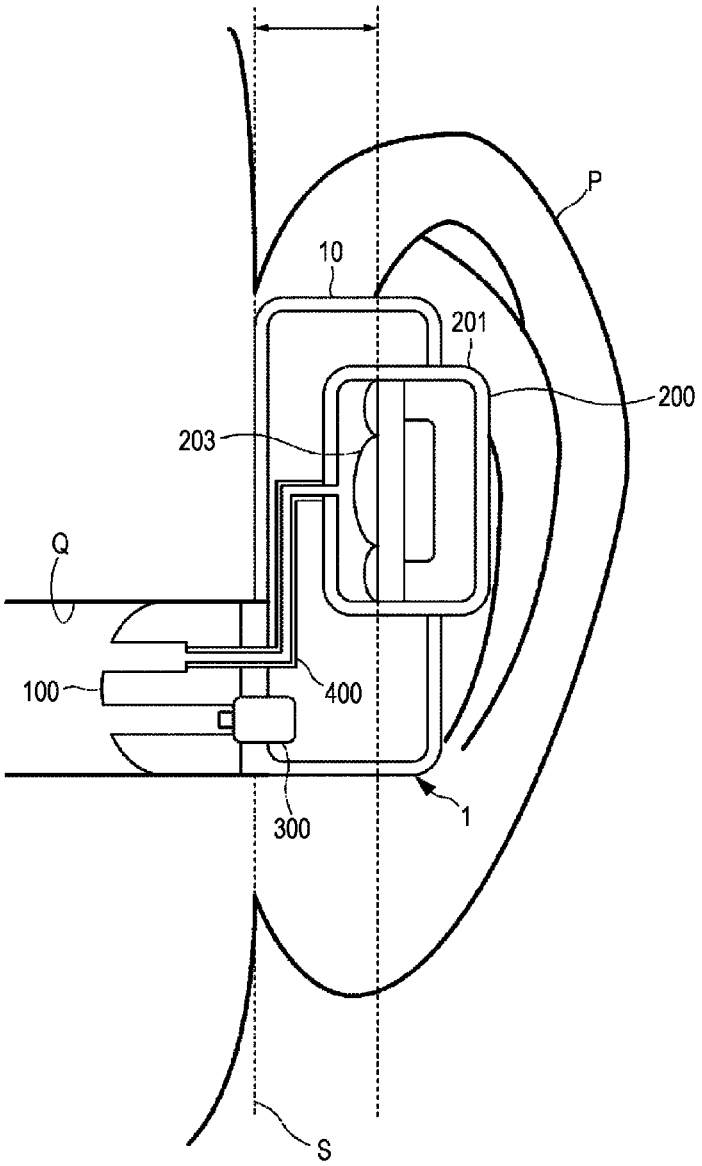
FIG. 3 is a diagram illustrating the positional relationship between a diaphragm of a dynamic driver unit included in the earphone and a user's ear.

A description is given here of the position of the earphone 1 with respect to the ear and face of a user with reference to FIG. 3. FIG. 3 is a state where a user is wearing the earphone 1 in his/her ear P, and is a state where the insertion portion 100 is inserted in an external auditory meatus Q of the ear P.

The dynamic driver unit 200 is desired to be outward of the side of the user's face in the state where the user is wearing the earphone 1. Furthermore, the dynamic driver unit 200 is desired to be outward of the tragus. Furthermore, as illustrated in FIG. 3, the diaphragm 203 of the dynamic driver unit 200 is desired to be located outward of the side of the user's face indicated by a line segment S. Incidentally, the dynamic driver unit 200 may be placed in the cavum conchae of the ear. When the user's ear has a certain size and the dynamic driver unit 200 is placed in the cavum conchae, the shape of the housing 10 is preferably adjusted to fit in the cavum conchae. This is because if the dynamic driver unit 200 is placed in the cavum conchae, the earphone 1 can be worn in a more stable state.

A first hole 211 is provided at substantially the center on a side provided with the diaphragm 203 in the case 201 of the dynamic driver unit 200. The first hole 211 is connected to the sound conduit 400, and is a sound output-purpose hole for transmitting the sound from the dynamic driver unit 200 to the sound conduit 400.

Figure 4:
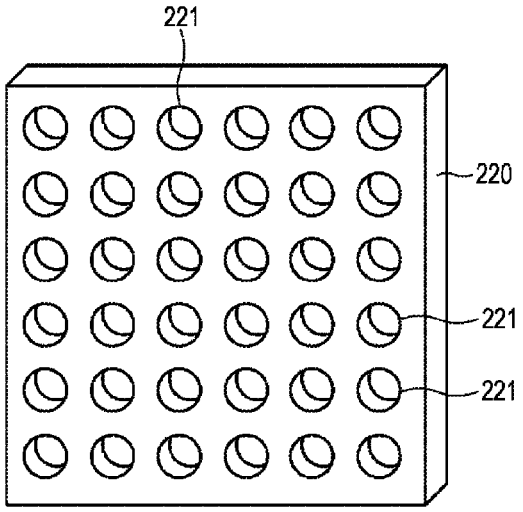
FIG. 4 is a diagram illustrating the configuration of a characteristics adjustment portion.

A second hole 212 is formed on the side provided with the diaphragm 203 in the case 201. As illustrated in FIG. 4, a plate body 220 having a plurality of small holes 221 and 221 is provided to the outside of an opening portion of the second hole 212. The plate body 220 is, for example, a metal plate made of stainless with a thickness of approximately 0.1 mm. The dimension of the small hole 221 formed in the plate body 220 is, for example, a diameter of substantially 0.1 mm. The plurality of small holes 221 provided to the plate body 220 corresponds to a characteristics adjustment portion in the claims.

A third hole 213 is provided at a position in the housing 10, the position being opposite to the side provided with the diaphragm 203 of the case 201. Furthermore, a fourth hole 214 is provided in a surface on the side exposed to the outside of the housing 10, the side being opposite to the side provided with the diaphragm 203 of the case 201. Incidentally, the number of the fourth holes 214 is not limited to one, but may be more than one.

One end of the sound conduit 400 to transmit the sound from the dynamic driver unit 200 is connected to the first hole 211 provided to the case 201. Moreover, the other end of the sound conduit 400 is inserted into the insertion portion 100 to be supported by the insertion portion 100.

The sound conduit 400 is a tube-shaped member including an elastic body with a substantially circular cross-section. The sound conduit 400 includes, for example, polyvinyl chloride. In the embodiment, the sound conduit 400 is configured to have a length of approximately 30 mm, and a diameter of approximately 1 mm. Incidentally, the length of the sound conduit 400 is preferably within a range of approximately 20 to approximately 40 mm, and more preferably approximately 30 mm. This dimension is relevant to the acoustic characteristics of the dynamic driver unit 200. The details are described below. Incidentally, the diameter of the first sound guide hole 101 connected to the sound conduit 400 is set to be slightly larger than the diameter of the sound conduit 400. The diameter of the first sound guide hole 101 is, for example, 2 mm.

A spring (not illustrated) is provided inside the sound conduit 400. The spring is provided such that an outer periphery thereof is in contact with an inner surface of the sound conduit 400. The spring supports the sound conduit 400 from inside to prevent the sound conduit 400 from crushing or bending. The sound conduit 400 is a very narrow component with a diameter of approximately 1 mm. Accordingly, the sound conduit 400 can crush or bend due to a slight impact unless the spring is provided therein to support the sound conduit 400 from inside.

The spring is preferably used which includes a metal material that is strong to a certain extent and is as narrow as possible to prevent the spring from blocking the inside of the sound conduit 400 or unnecessarily reducing the internal space of the sound conduit 400.

The BA driver unit 300 is provided in the housing 10. The BA driver unit 300 includes, in a casing thereof, an armature, a voice coil, a magnet, a driver rod, and a diaphragm (none of them are illustrated.). The BA driver unit 300 vibrates the diaphragm by the driver rod that is provided in such a manner as to connect the armature and the diaphragm, and generates a sound. The BA driver unit 300 can achieve clearer and more distinct mid- and high-frequency outputs than a driver unit of another type.

An outer surface of the BA driver unit 300 is provided with a duct-shaped sound output tube 301. The sound of the BA driver unit 300 is output from the sound output tube 301. The BA driver unit 300 is provided such that the sound output tube 301 is located inside the second sound guide hole 103 formed in the insertion portion 100. Furthermore, the side, provided with the sound output tube 301, of the casing of the BA driver unit 300 is provided in such a manner as to be buried in the insertion portion 100. The sound of the BA driver unit 300 travels from the sound output tube 301 through the second sound guide hole 103 and is output last from the second sound output port 104.

The BA driver unit 300 is provided such that a part thereof is buried in the insertion portion 100; accordingly, the BA driver unit 300 can be fixed in the housing 10 in a stable state. Moreover, the BA driver unit 300 can be located near the distal end of the insertion portion 100 from which sound is output last.

Figure 5:
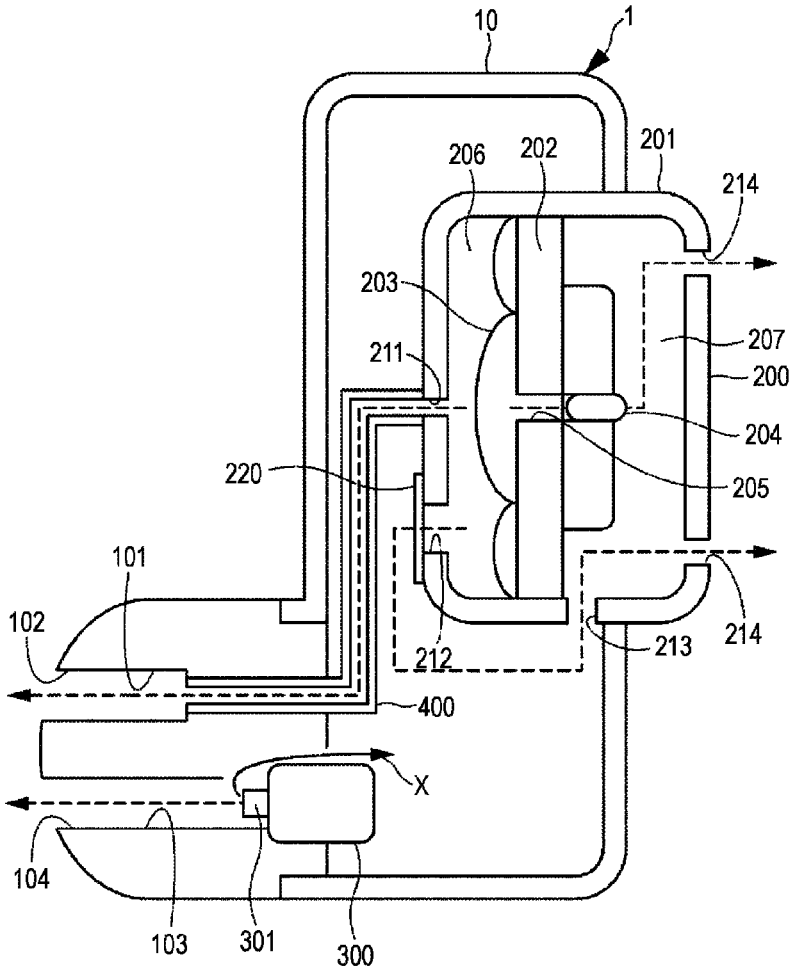
FIG. 5 is a diagram illustrating the flow of sound in the earphone.

When a part of the BA driver unit 300 is buried in the insertion portion 100, it is necessary to increase airtightness between the BA driver unit 300 and the insertion portion 100 to prevent a gap from being created between the BA driver unit 300 and the insertion portion 100, and the second sound guide hole 103 and the inside of the housing 10 from communicating with each other as indicated by an arrow X of FIG. 5. This is for the purpose of preventing reductions in sound volume, resolution, and the like due to leakage of the sound of the BA driver unit 300.

In order to hold the BA driver unit 300 in the stable state, it is preferable to provide the BA driver unit 300 such that approximately one-third or more of a surface area thereof is buried in the insertion portion 100.

Incidentally, if the BA driver unit 300 does not include the duct-shaped sound output tube 301 but includes a hole for outputting sound, it is necessary to provide the BA driver unit 300 such that the hole for outputting sound is open in the second sound guide hole 103.

In the embodiment, the second sound guide hole 103 is configured to have a length of approximately 10 mm and a diameter of approximately 2 mm. The volume level of the sound from the BA driver unit 300 can be adjusted by adjusting a distance between the BA driver unit 300 and the second sound output port 104, that is, the length of the second sound guide hole 103. The volume level of the sound from the balanced armature driver unit can be increased by reducing the length of the second sound guide hole 103 and reducing the distance between the BA driver unit 300 and the second sound output port 104. Moreover, the volume level of the sound from the BA driver unit 300 can be reduced by increasing the length of the second sound guide hole 103 and increasing the distance between the BA driver unit 300 and the second sound output port 104.

As illustrated in FIGS. 1A, 1B, 1C, 1D, 1E, 1F and 1G, the cylindrical portion 500 is integrally attached to the dynamic driver unit 200. The cylindrical portion 500 is configured to be hollow inside. The cord 600 is introduced into the cylindrical portion 500 from one end of the cylindrical portion 500. The cylindrical portion 500 accommodates the cord 600 therein and also takes a role in the protection of a connected part between the cord 600 and the dynamic driver unit 200.

The cord 600 is connected at one end to the dynamic driver unit 200 through the inside of the cylindrical portion 500. Furthermore, the dynamic driver unit 200 and the BA driver unit 300 are connected by a cord (not illustrated). Moreover, the cord 600 is provided at the other end with a plug (not illustrated) in a state where an L-side cord and an R-side cord are bundled. The plug is connected to a sound reproducing apparatus (not illustrated) such as a smartphone or MP3 player to connect the earphone 110 to the sound reproducing apparatus. Examples of the sound reproducing apparatus include a mobile MP3 player, a smartphone, a mobile phone, a mobile game machine, a mobile disc medium reproducing apparatus, a tablet terminal, a personal computer, a system stereo, and a television receiving set.

An audio signal output from the sound reproducing apparatus is transmitted by the cord 600 to be supplied to the dynamic driver unit 200 and the BA driver unit 300.

The earphone 1 is configured as described above. Incidentally, in the drawings, only the left earphone is illustrated. However, generally, left and right earphones are configured to be a pair. However, a monaural earphone is configured to include only a left or right earphone.

[1-2. Acoustic Characteristics of the Earphone]

Figure 6:
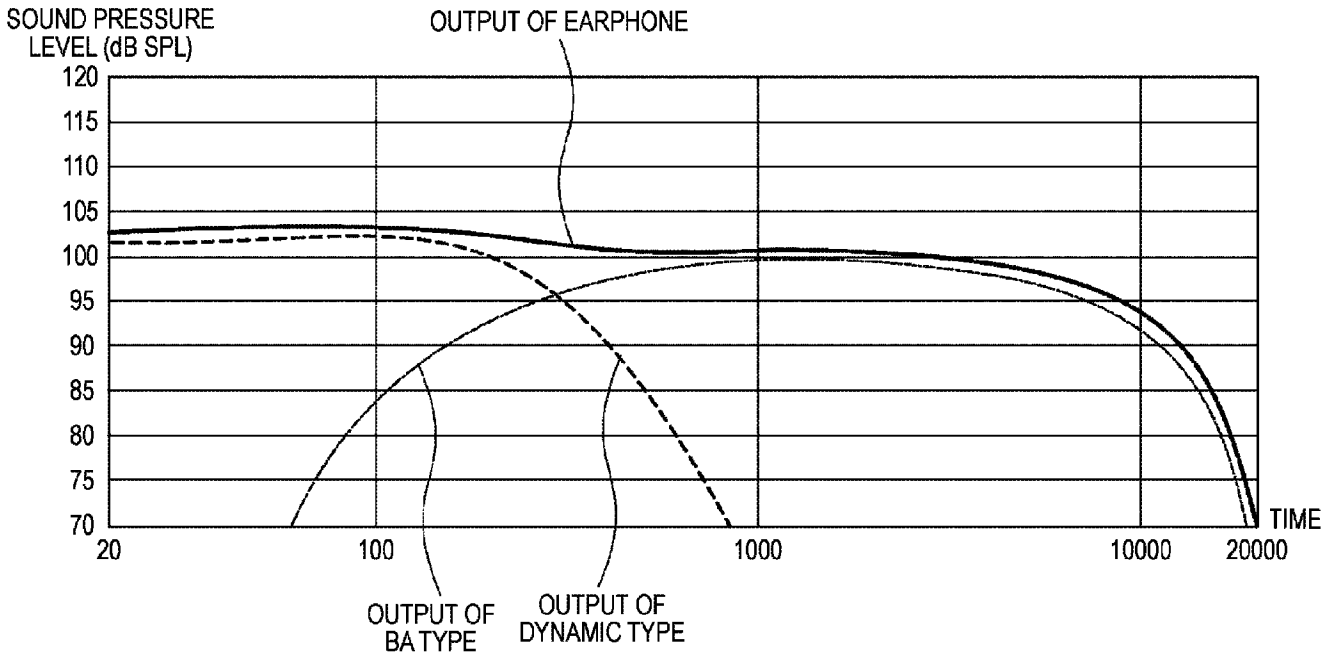
FIG. 6 is a graph illustrating the acoustic characteristics of the earphone.

Next, the acoustic characteristics of the earphone 1 are described. FIG. 6 is a graph illustrating the acoustic characteristics of the earphone 1 according to the embodiment, which includes the dynamic driver unit 200 and the BAdriver unit 300. The vertical axis represents the sound pressure level (dB SPL). The horizontal axis represents time. A broken line of the graph indicates the acoustic characteristics of the dynamic driver unit 200. A dot-and-dash line indicates the acoustic characteristics of the BA driver unit 300. In addition, a solid line of the graph indicates the acoustic characteristics of the entire earphone 1 with both outputs of the dynamic driver unit 200 and the BA driver unit 300.

In the embodiment, the dynamic driver unit 200 is responsible for output in a low-frequency range. The BA driver unit 300 is responsible for output in mid- and high-frequency ranges. The dynamic driver unit 200 includes the large diaphragm 203 and accordingly can achieve a powerful low-frequency output. Moreover, the BA driver unit 300 can achieve clearer and more distinct mid- and high-frequency outputs than a driver unit of another type. Hence, the dynamic driver unit 200 is responsible for the low-frequency range, and the BA driver unit 300 is responsible for the mid- and high-frequency ranges. Accordingly, powerful and clear sounds can be output.

The sound conduit 400 serves as an acoustic resistance component in the dynamic driver unit 200, and acts as what is called a low-pass filter that passes only low frequencies. An acoustic low-pass filter can be formed with the use of the principle of a Helmholtz resonance box and the settings of the capacity of the first air chamber 206, which is the space at the front of the diaphragm 203, and the inertance of the sound conduit 400.

Specifically, the length and diameter of the tube are adjusted to achieve the adjustment of a frequency band that is allowed to pass. Incidentally, there is a correlation between the square of the diameter and the length of the sound conduit 400. When the length is reduced, the diameter is reduced. A cutoff frequency of the low-pass filter is determined by the length and diameter of the sound conduit 400. If, for example, an attempt is made to maintain the acoustic characteristics of the dynamic driver unit 200 although the sound conduit 400 is extended, it is necessary to increase the diameter of the sound conduit 400. Hence, if, for example, the acoustic characteristics are desired to be maintained although the sound conduit 400 is extended in accordance with the size of the housing 10 that is increased to fit the size of the user's ear, it is necessary to increase the diameter of the sound conduit 400.

A capacity of approximately 3 cc of the first air chamber 206 is determined to a certain extent from limitations to the selection and structure of the dynamic driver unit 200. Moreover, in the embodiment, the diameter of the sound conduit 400 is preferably approximately 1 mm considering the accommodation of the entire sound conduit 400 in the housing 10 and resistance to bending. Furthermore, the cutoff frequency of the filter is set at 150 Hz with respect to the output of the dynamic driver unit 200. The length of the sound conduit 400 is adjusted to set the cutoff frequency at 150 Hz. As a result, the length of the sound conduit 400 is set at approximately 30 mm.

An acoustic influence is recognized when the length of the sound conduit 400 is greater than the diameter thereof. However, in order to achieve an influence in an audible frequency range, the length of the sound conduit 400 is required to be 10 mm or longer when the diameter of the sound conduit 400 is 1 mm. When the sound conduit 400 is caused to function as a low-pass filter, an effective length of the sound conduit 400 is considered to be approximately 20 mm to approximately 40 mm.

Moreover, the amount of the sound-absorbing material filled in the case 201 of the dynamic driver unit 200 is adjusted to achieve the adjustment of the volume level of the sound from the dynamic driver unit 200. When the volume level of the sound from the dynamic driver unit 200 is increased, the amount of the sound-absorbing material filled is required to be reduced. When the volume level is reduced, the amount of the sound-absorbing material filled is required to be increased.

Incidentally, the BA driver unit 300 does not influence the adjustment of the acoustic characteristics of the dynamic driver unit 200.

Figure 7:
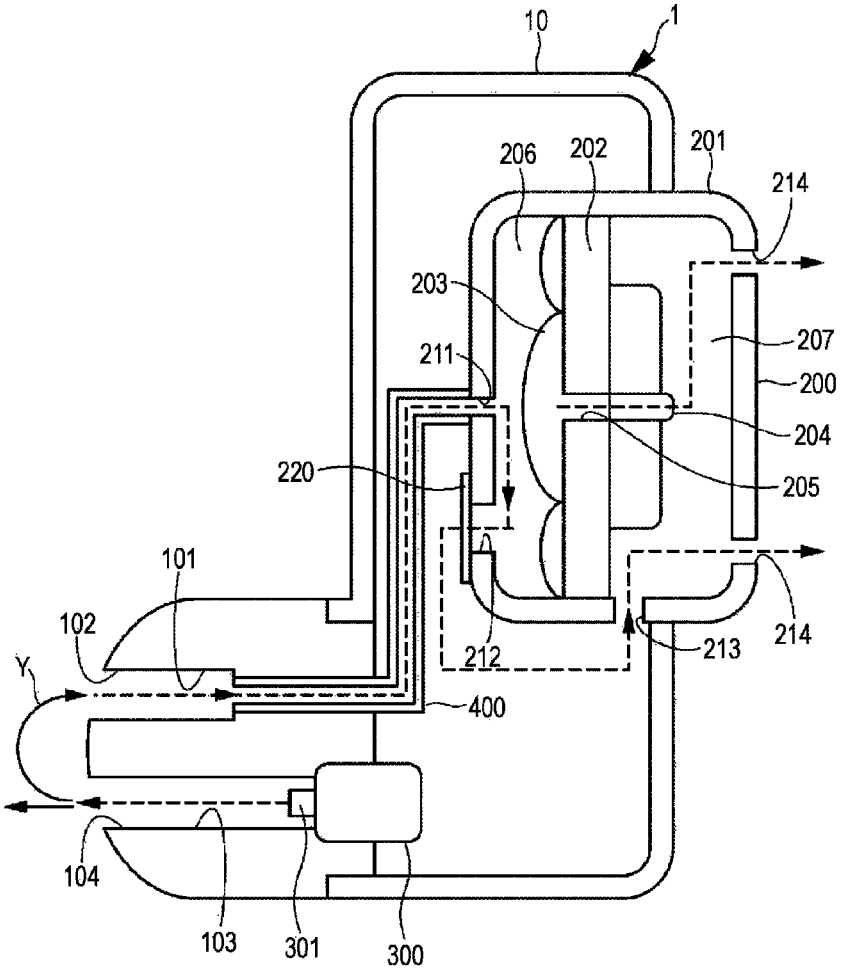
FIG. 7 is a diagram describing a configuration for adjusting the acoustic characteristics of a balanced armature driver unit.

The internal structure of the earphone 1 serves as an acoustic resistance component in the BA driver unit 300, and acts as a filter that passes the mid and high frequencies. This point is described with reference to FIG. 7.

The sound from the BA driver unit 300 is output as sound from the second sound output port 104 through the second sound guide hole 103. At this point in time, part of the sound output from the second sound output port 104 enters the first sound guide hole 101 from the first sound output port 102 as indicated by an arrow Y of FIG. 7, and is guided into the dynamic driver unit 200 from the sound conduit 400. Next, the sound from the BA driver unit 300 guided into the dynamic driver unit 200 is led outside the dynamic driver unit 200 from the second hole 212, and guided again into the dynamic driver unit 200 from the third hole 213. The sound is then led last outside the earphone 1 from the fourth hole 214.

With such a configuration, part of the sound of the BA driver unit 300 is released to the outside to attenuate the low frequencies; accordingly, the function as the filter that passes only the mid and high frequencies is achieved. Incidentally, as described above, the second hole 212 is provided with the plate body 220 including the plurality of small holes 221. The number of the small holes 221 of the plate body 220 and/or the dimension thereof are adjusted to adjust the quantity of airflow; accordingly, the frequency band that is allowed to pass can be adjusted. The quantity of airflow of the plate body 220 is increased to enable a reduction in sensitivity in the low-frequency range. Moreover, the quantity of airflow of the plate body 220 is reduced to enable an increase in sensitivity in the low-frequency range.

Incidentally, the dynamic driver unit 200 does not influence the adjustment of the acoustic characteristics of the BA driver unit 300.

In this manner, the volume level and acoustic characteristics of the dynamic driver unit 200 and the volume level and acoustic characteristics of the BA driver unit 300 can be adjusted separately.

As described above, the acoustic characteristics of the earphone 1 in the embodiment are determined. According to the present technology, the adjustment of the frequency band and the adjustment of the volume level according to the frequency band can be made using two types of driver units; accordingly, the acoustic characteristics of a sound to be output can be adjusted. Consequently, an earphone with acoustic characteristics in agreement with the user's preference, the genre of music that the user listens to, and the like is made possible. An earphone with acoustic characteristics for each user can be produced. Accordingly, the needs of the user can be met. In addition, an earphone suitable for the user can be proposed. Hence, the present technology is suitable as earphones for high-end users and users who are particular about audio quality. Moreover, the present technology is also suitable as an in-ear monitor for a musician at the time of live performance.

Moreover, even if the shape of the housing 10, the length of the insertion portion 100, the length of the sound conduit 400, and the like are changed according to the shape of a user's ear, it is also possible to keep the acoustic characteristics unchanged by adjusting the quantity of airflow of the characteristics adjustment portion, the amount of the sound-absorbing material, and the diameter of the sound conduit 400 accordingly.

Furthermore, it is configured such that the acoustic characteristics of the earphone 1 can be adjusted in this manner. Accordingly, desired acoustic characteristics can be achieved without using an electric filter and the like. The number of electric components and electronic components in the earphone 1 is minimized to enable the reduction of the component cost and the simplification of the production process. Moreover, for example, a change in impedance resulting from electrical components and electronic components is little; accordingly, the production is facilitated. Moreover, the frequency of occurrence of a failure can also be reduced since the number of electric components and electronic components is low. Furthermore, even if a failure occurs, it also becomes easier to identify the location of the failure and repair it.

2. Modifications

Up to this point the embodiment of the present technology has been specifically described. However, the present technology is not limited to the above-mentioned embodiment, and various modifications can be made on the basis of the technical principles of the present technology.

In the above-mentioned embodiment, the description is given taking, as an example, the case where the number of the BA driver units is one. However, the number of the BA driver units is not limited to one, but may be more than one.

If, for example, two BA driver units are provided, the roles of the BA driver units can be separated into the high-frequency range and the middle-frequency range. In this case, it is preferable to provide the two BA driver units adjacently in the housing 10. Incidentally, each of the BA driver units may be provided with a sound guide hole and a sound output port, or the two BA driver units may share one sound guide hole and one sound output port.

Moreover, if, for example, a user's ear is small and it is necessary to reduce the size of the dynamic driver unit 200, the BA driver unit may compensate the low-frequency range reduced by the size reduction. Two BA driver units are provided to set one of them for the mid- and high-frequency ranges and the other for the low-frequency range. In this case, it is also possible to make the dynamic driver unit 200 responsible only for a very low-frequency range being a lower frequency band than the low-frequency range.

In the above-mentioned embodiment, the earphone 1 and the sound reproducing apparatus are connected by the cord 600. However, the earphone 1 and the sound reproducing apparatus may be connected by another method, for example, Bluetooth short-range wireless communication. In this case, a casing may be provided on an opposite side of the cord 600 to the side connected to the earphone 1 to provide, in the casing, a Bluetooth communication module, an antenna, a battery, and the like, which are necessary for Bluetooth communication, or they may be accommodated in the housing 10 without providing the cord 600. Incidentally, in this case, the sound reproducing apparatus functions as the master in Bluetooth, and the earphone 1 functions as the slave.

Furthermore, a wireless communication method different from Bluetooth, for example, Wireless Fidelity (Wi-Fi) or ZigBee, may be used to establish a connection between the sound reproducing apparatus and the earphone 1. Also in this case, as in the above-mentioned case of Bluetooth, a casing may be provided on an opposite side of the cord 600 to the side connected to the earphone 1 to accommodate various configurations such as a communication antenna in the casing, or to accommodate them in the housing 10 without providing the cord 600.

Moreover, configurations necessary to cancel noise, such as a noise canceling circuit and a noise collecting microphone to collect noise and supply it to the noise canceling circuit, may be provided to the housing 10 to cause the earphone to have a noise canceling function. A noise canceling on/off switch may be provided in such a manner as to be exposed to an outer surface of the housing 10.

Moreover, the earphone and the sound reproducing apparatus may be configured to be integrated. In this case, audio data saving memory, an audio signal processing circuit, a control circuit, a battery, and the like may be provided in the housing 10, and an operating unit may be provided in such a manner as to be exposed to the outer surface of the housing 10. Furthermore, in this case, an earphone-integrated sound reproducing apparatus may be made waterproof.

The present technology can also employ the following configurations.

(1)
An earphone including:
a housing;
a dynamic driver unit provided in the housing; and
a sound conduit having a length of approximately 10 mm or more, the sound conduit being configured to transmit sound output from the dynamic driver unit.

(2)
The earphone according to (1), wherein a length of the sound conduit is equal to or more than approximately 10 mm and equal to or less than 40 mm.

(3)
The earphone according to (1) or (2), wherein the length of the sound conduit is approximately 30 mm.

(4)
The earphone according to any of (1) to (3), wherein a diameter of the sound conduit is approximately 1 mm.

(5)
The earphone according to any of (1) to (4), wherein the sound conduit includes a spring body therein.

(6)
The earphone according to any of (1) to (5), further including a balanced armature driver unit.

(7)
The earphone according to (6), wherein part of sound output from the balanced armature driver unit is led outside through the dynamic driver unit to attenuate low frequencies of the sound output from the balanced armature driver unit.

(8)
The earphone according to (7), wherein the dynamic driver unit is provided with a characteristics adjustment portion configured to adjust characteristics of the sound from the balanced armature driver unit.

(9)

The earphone according to (8), wherein the characteristics adjustment portion is a plurality of small holes provided on a path where the sound output from the balanced armature driver unit passes.

(10)

The earphone according to any of (1) to (9), wherein the dynamic driver unit is provided in such a manner as to be located outward of a side of a user's face while the user is wearing the earphone.

(11)

The earphone according to (10), wherein the dynamic driver unit is provided in such a manner as to be located outward of the tragus of the user.

(12)

The earphone according to any of (1) to (11), wherein the housing is formed to fit the shape of the user's ear.

(13)

The earphone according to any of (1) to (12), including:

the housing;

an insertion portion configured to be more flexible than the housing, the insertion portion being attached to the housing; and the balanced armature driver unit provided in the housing, a part of which is buried in the insertion portion in intimate contact therewith.

(14)

The earphone according to any of (1) to (13), wherein the insertion portion includes, therein, a sound guide hole configured to guide sound output from the balanced armature driver unit to an outside of the insertion portion, and the balanced armature driver unit is buried in intimate contact with the insertion portion without the sound guide hole communicating with an inside of the housing.

(15)

The earphone according to any of (1) to (14), wherein the balanced armature driver unit is provided such that approximately one-third or more of a surface area thereof is buried in the insertion portion.

(16)

The earphone according to any of (1) to (15), wherein a length of the sound guide hole is approximately 10 mm.

(17)

The earphone according to any of (1) to (16), wherein the housing includes UV hardening resin.

(18)

The earphone according to any of (1) to (17), wherein the insertion portion includes UV hardening resin having thermoplasticity.

(19)

The earphone according to any of (1) to (18), further including the dynamic driver unit.

(20)

The earphone according to any of (1) to (19), wherein the insertion portion includes, therein, a second sound guide hole configured to guide sound output from the dynamic driver unit to the outside of the insertion portion, and the housing includes, therein, the sound conduit configured to transmit the sound from the dynamic driver unit to the second sound guide hole.

(21)

The earphone according to any of (1) to (20), wherein the sound conduit is connected at one end to the dynamic driver unit, and is fixed at the other end by being inserted into the insertion portion to communicate with the second sound guide hole.

(22)

The earphone according to any of (1) to (21), wherein a part of the housing is placed in the insertion portion.

(23)

The earphone according to any of (1) to (22), wherein the housing has a thickness of approximately 0.5 mm or more.

(24)

The earphone according to any of (1) to (23), wherein the housing has a thickness of approximately 0.5 mm to approximately 1.5 mm.

REFERENCE SIGNS LIST

1 Earphone
10 Housing
100 Insertion portion
101 First sound guide hole
103 Second sound guide hole
200 Dynamic driver unit
203 Diaphragm
220 Plate body
300 Balanced armature driver unit
400 Acoustic tube

The invention claimed is:

1. An earphone comprising:

a housing which comprises a dynamic driver unit;

a sound conduit configured to transmit a first sound output from the dynamic driver unit; and a balance armature driver unit configured to output a second sound, wherein at least a part of the second sound is released outside the housing, through the dynamic driver unit, to attenuate low frequencies of the second sound.

2. The earphone according to claim 1, wherein a length of the sound conduit is less than or equal to 40 mm.

3. The earphone according to claim 2, wherein the length of the sound conduit is 30 mm.

4. The earphone according to claim 1, wherein a diameter of the sound conduit is 1 mm.

5. The earphone according to claim 1, wherein the sound conduit includes a spring body.

6. The earphone according to claim 1, wherein the dynamic driver unit comprises a characteristics adjustment portion configured to adjust characteristics of the second sound.

7. The earphone according to claim 6, wherein the characteristics adjustment portion comprises a plurality of small holes, and wherein the second sound passes through the characteristics adjustment portion.

8. The earphone according to claim 1, wherein the dynamic driver unit is wearable outside a face of a user.

9. The earphone according to claim 8, wherein the dynamic driver unit is wearable outside of a tragus of the user.

10. The earphone according to claim 9, wherein the housing has a shape to fit into an ear of the user.

11. The earphone according to claim 1, wherein the first sound is released from the housing via a guide hole.

12. The earphone according to claim 1, wherein the balance armature driver unit comprises a voice coil, a driver rod, and a diaphragm.

13. The earphone according to claim 12, wherein the balance armature driver unit is configured to vibrate the diaphragm by the driver rod.

14. The earphone according to claim 1, wherein the dynamic driver unit comprises an air flow resistor, a hole-shaped air vent, and a diaphragm.

15. The earphone according to claim 1, wherein the dynamic driver unit comprises a case filled with a sound absorbing material.

16. The earphone according to claim 1, wherein a thickness of the housing is less than or equal to 1.5 mm.

17. The earphone according to claim 1, further comprising a cord connected to the dynamic driver unit through a cylindrical portion.

18. The earphone according to claim 1, wherein the housing further comprises a UV hardening resin.

* * * * *